US005230440A

United States Patent [19]

Kurokawa

[11] Patent Number: 5,230,440

[45] Date of Patent: Jul. 27, 1993

[54] GRANULAR BODY DISCHARGE CONTAINER, GRANULAR BODY STORAGE TUBE AND GRANULAR BODY ASSEMBLY

[75] Inventor: Takumi Kurokawa, Soka, Japan

[73] Assignee: Pentel Kabushiki Kaisha, Tokyo, Japan

[21] Appl. No.: 773,620

[22] PCT Filed: Apr. 23, 1991

[86] PCT No.: PCT/JP91/00536

§ 371 Date: Nov. 14, 1991

§ 102(e) Date: Nov. 14, 1991

[87] PCT Pub. No.: WO91/16247

PCT Pub. Date: Oct. 31, 1991

[30] Foreign Application Priority Data

Apr. 26, 1990 [JP] Japan ..... 2-44698[U]
May 31, 1990 [JP] Japan ..... 2-57716[U]
Jul. 27, 1990 [JP] Japan ..... 2-80498[U]

[51] Int. Cl.[5] ..... B65H 1/08

[52] U.S. Cl. ..... 221/7; 221/8; 221/198; 221/227; 221/232

[58] Field of Search ..... 221/2, 4, 5, 8, 155, 221/198, 226, 227, 232, 260, 279, 287, 45, 7; 227/120

[56] References Cited

U.S. PATENT DOCUMENTS 1,890,388 12/1932 Kromlik ..... 221/279
2,632,889 3/1953 Beecroft ..... 227/120
3,270,915 9/1966 Auer ..... 221/232
3,344,951 10/1967 Gervais ..... 221/7
3,471,056 10/1969 Kovac .
3,511,409 5/1970 Huck .
3,612,348 10/1971 Thomas .
3,612,349 10/1971 Thomas .
3,687,336 8/1972 Gayle .
3,762,539 10/1973 Kerr .
3,845,882 11/1974 Hass ..... 221/279
3,854,625 12/1974 Kuebler .
4,154,365 5/1979 Lorca ..... 221/4
4,541,547 9/1985 Miknyocki ..... 221/260
4,589,575 5/1986 Rigberg et al. .

FOREIGN PATENT DOCUMENTS 3445121 6/1986 Fed. Rep. of Germany .
60-24779 2/1985 Japan .
0100533 12/1940 Sweden ..... 221/260

*Primary Examiner*—H. Grant Skaggs
*Attorney, Agent, or Firm*—Wenderoth, Lind & Ponack

[57] ABSTRACT

Granular body discharge containers for holding granular bodies, such as oral conceptives, vitamin tablets or candies in a line so that the granular bodies can be discharged have an operating member for discharging the granular bodies is urged in the direction of a linear arrangement of the granular bodies. A side wall of a storage portion is open and releasably receives a storage tube. A granular body receiving member is disposed the a resilient member for urging the granular bodies in a discharging direction. A spring receiving member can be formed unitarily and separably with the granular body receiving member. Indications showing the order of use of the granular bodies are provided on a granular body receiving member serving as an index for these indications. The indications can be provided on a rotary member adapted to be turned at a predetermined angle every time an operating member is pressed. A granular body storage tube can be housed in the discharge container, the storage tube adapted to hold the granular bodies in a line, and has a removable plug that holds the granular bodies therein. The storage tube has a spring biasing granular bodies and a projection on its bottom wall forming a fixing portion with respect to the granular body discharge container. A granular body receiving member is provided between the spring.

12 Claims, 11 Drawing Sheets

GRANULAR BODY DISCHARGE CONTAINER, GRANULAR BODY STORAGE TUBE AND GRANULAR BODY ASSEMBLY

BACKGROUND OF THE INVENTION (1) Field of the Invention

The present invention relates to a granular body discharge container capable of holding in a line tablets, such as oral (peroral) contraceptives, ignition stones for lighters, or sweets, such as candies and lemon pop cakes, and a granular body storage tube capable of being housed in a granular body holding portion of such a granular body discharge container. Further, the present invention provides a granular body assembly, for example a tablet assembly which can be inserted in a predetermined order in such a granular body storage tube so that granular bodies of the assembly can be discharged one by one.

(2) State of the Prior Art

An example of the above-described type of granular body discharge container, capable of holding granular bodies in a line therein and discharging the same one by one therefrom, is disclosed in Japanese Utility Model Publication No. 60-24799/1985 (Unexamined). This example is a reagent disc storage container holding reagent discs in a laminated or alignment state and is provided with an extrusion plate so that these discs can be extruded one by one from a side of the container.

Another example of a granular body storage tube adapted to store therein granular bodies in a predetermined order is a storage tube which has a film capable of being easily torn, such as, aluminum foil pasted on one surface thereof. This storage tube holds therein capsulated tablets adapted to be taken out by breaking the film. This type of a storage tube, which holds peroral contraceptives, is commercially available in Australia. According to the instruction manual for this product, 28 tablets are inserted in a generally rectangular storage tube, so that the tablets are arranged in a circle substantially along the circumferential portion thereof, and days of the week, such as Monday, Tuesday, Wenesday etc., for four weeks are displayed on a position on the outer surface of the storage tube where the tablets are held. A tablet held in a position corresponding to a mark of, for example, "MON" or "Monday" can be used on Monday in accordance with the instructions for use of the tablets.

When efficiency in the use of such granular bodies, i.e. the discharge of such granular bodies, is taken into consideration, it is found that the container for simply discharging granular boides as disclosed in the Japanese publication is more conveniently used than the container of the type having a film as described above, because the granular bodies arranged in the container are taken out more easily than granular bodies adapted to be taken out by breaking a film.

However, if the granular bodies held in a line in a storage tube like those disclosed in the above-mentioned Japanese publication are adapted to be taken out by extruding them sideways with respect to the longitudinal arrangement of the granular bodies, the direction of extrusion of the granular bodies is different from the direction of the longitudinal arrangement of the granular bodies. Consequently, a container for such granular bodies is formed generally in the shape of, for example, the letter "L" or "T" as a necessity. If an additional structure is provided on this container, the general shape of the container can be changed as desired, of course, but such a container is basically bulky and becomes very inconvenient for being carried in user's pocket or handbag.

The use of these granular bodies held directly in a granular body discharge container without using a cartridge or the like is disadvantageous in that they are necessarily stored in such a container even when they have not yet been used, and in that it is troublesome to refill granular bodies one by one as they are consumed.

In order to discharge the granular bodies sequentially, a resilient member such as a spring is used to urge them toward a discharge port. However, if so many granular bodies are held in the container, a longer resilient member is necessary, and the resilient member must be compressed greatly when the granular bodies are inserted into the container. This causes the assembling of the container to become troublesome.

In the case where the order of use of the granular bodies like the above-mentioned oral conceptives is predetermined, it is necessary that a granular body to be actually used can be identified.

Also, in the case where the order of use of the granular bodies is predetermined, the order of use becomes unknown if more than desired number of granular bodies should have been taken out.

SUMMARY OF THE INVENTION

An object of the present invention is to solve the problems of these conventional techniques and provide a compact and portable granular body discharge container.

Another object of the present invention is to provide a granular body storage tube which can be attached as a refill to a granular body discharge container, and which can be used by itself as a granular body discharge container.

Still another object of the present invention is to provide a granular body discharge container which allows a granular body storage tube to be attached as a refill thereto easily and reliably, and which is capable of discharging the granular bodies reliably after the granular body storage tube has been attached thereto.

A further object of the present invention is to provide a granular body storage tube releasably attached to a granular body discharge container.

A further object of the present invention is to provide a granular body discharge container and a granular body storage tube into which a large number of granular bodies can be easily inserted, and which can be assembled easily.

A further object of the present invention is to provide a granular body discharge container in which a granular body to be actually used can be identified easily when the order of use of the granular bodies is determined in advance.

A further object of the present invention is to provide a granular body assembly which can prevent the predetermined order of use of each granular body therein from becoming unidentifiable even if more than desired number of granular bodies should have been taken out.

These and other objects of the present invention will become apparent from the following description.

The present invention provides a granular body discharge container having a granular body storage portion for holding a plurality of granular bodies in a line, a discharge port at one end of the granular body storage portion, and a pressing unit for extruding the granular bodies to the discharge port, wherein the pressing unit comprises an operation member movable in a longitudinal direction of the longitudinal arrangement of the granular bodies, a pusher member for urging the granular bodies from the side surfaces thereof, and a converting member for connecting the operating member with the pusher member to thereby change the direction of an urging force of the pusher member so that the granular bodies are discharged sideways with respect to the longitudinal direction of the arrangement of the granular bodies.

The present invention further provides a granular body discharge container comprising a granular body storage tube for holding a plurality of granular bodies in a line, a discharge port at one end of the granular body storage port, a pressing unit for extruding the granular bodies in the storage tube to the discharge port, wherein the storage tube has a cylindrical body having an open end and a through hole formed in the portion of a side wall of the tube body in the vicinity of the open end, a resilient member in the cylindrical body for resiliently holding a plurality of granular bodies in a line in the cylindrical body so that the granular bodies are urged by the resilient member toward the open end, and a removable plug, inserted in the through hole in the cylindrical body, for preventing the granular bodies from flying out through the open end under the resilient force of the resilient member.

The present invention further provides a granular body storage portion for releasably holding a granular storage tube containing therein a plurality of granular bodies, a discharge portion positioned at one end of the granular body storage portion, and a pressing unit for extruding the granular bodies to the discharge portion, wherein the granular body storage portion is opened at its side walls and has on its bottom surface a concave-convex locking means, whereby the granular body storage tube can be releasably attached to the granular body storage portion through an opened side wall thereof.

The present invention also provides a granular body storage tube removably held in a discharge container, wherein the storage tube has a cylindrical body for holding therein granular bodies in a line and a resilient member for urging the granular bodies, the resilient member having a projecting portion projecting resiliently at its rear end portion from the bottom portion of the cylindrical body for fixing the cylindrical body to the discharge container.

The present invention also provides a granular body discharge container comprising a releasable cylindrical body for holding a plurality of granular bodies in a line, a resilient member for urging the granular bodies toward a discharge port, and a first receiving member for receiving the resilient member, and a second receiving member interposed between the resilient member and the granular bodies for receiving the granular bodies, wherein the first and second receiving members are separably engaged with each other against the resilient force thereof so that the two integrally engaged two receiving members can be separated from each other before the granular bodies in the discharge container are, put to use.

The present invention further provides a granular body storage tube having a cylindrical tube for holding a plurality of granular bodies in a line, a resilient member for urging the granular bodies toward a discharge port thereof, a first receiving member for receiving the resilient member, and a granular body receiving member interposed between the resilient member and the granular bodies for receiving the granular bodies, the first receiving member and the second receiving member being formed separably and assembled in an integral form with the resilient member compressed against the resilient force thereof, so that the first receiving member and the second receiving member can be separated from each other before the granular bodies in the discharge container are put to use.

The present invention further contemplates a granular body discharge container comprising a cylindrical body for holding a plurality of granular bodies in a line, a resilient member for urging these granular bodies toward a discharge port thereof wherein the discharge container further includes a window for viewing the granular bodies therethrough, a display along the window for indicating the order of use of the granular bodies, and a receiving member, disposed between the resilient member and granular bodies so that the receiving member can also be seen through the window, for receiving a granular body and serving as an index for the display.

The present invention further provides a granular body discharge container comprising a storage portion for holding a plurality of granular bodies in a line, a discharge port positioned at one end of the storage portion, a pressing unit for extruding the granular bodies to the discharge port, a window and a rotary member rotatable at a predetermined angle every time the pressing unit is operated, wherein the rotary member is disposed in the discharge container so that the rotary member can be seen through the window, the rotary member having a display so that the display can be seen through the window to thereby recognize the order of use of a granular body to be actually used.

The present invention provides, furthermore, a granular body assembly comprising a plurality of granular bodies held in a predetermined order in a granular body storage tube, each of the granular bodies having a mark showing the order of use of the granular bodies in the storage tube.

PREFERRED EMBODIMENT OF THE INVENTION

Figure 1:
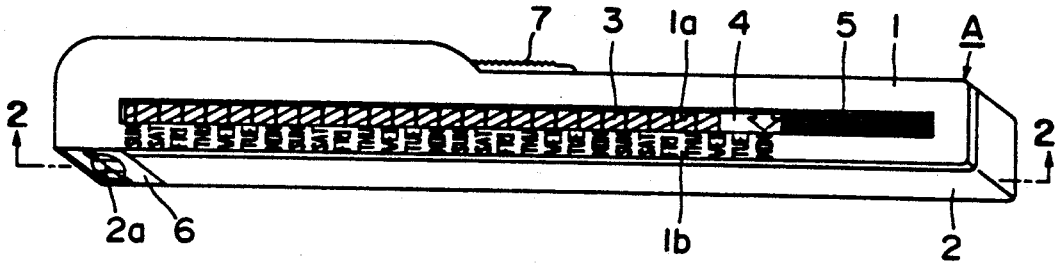
FIG. 1 is a perspective view of a discharge container according to the present invention.

Referring to FIG. 1, a granular body discharge container A, which is generally in the shape of a rod, has a container body 2 and a cover 1 fixed detachably to the container body 2. The cover 1 has a window 1*a* through which the granular bodies 3 held in a line in the container body 2 can be seen and indications 1*b* along the window 1*a* with the same pitch as the thickness of each granular body 3. The number of the granular bodies is set to 28, and the indications 1*b* shown in the drawing represent the days of the week as Sunday, Monday, . . . , Saturday. The discharge container of FIG. 1 is an example applied to oral or peroral contraceptives, and the indications 1*b* represent a suitable order of use determined in accordance with the type of the granular bodies 3. An arrow is shown at the right end of the indications 1*b*. A member having this arrow is a granular body receiving member 4, which is urged to left in the drawing by a resilient member 5, such as a spring provided on the rear portion (right-hand portion in the drawing) of the granular body receiving member 4. The container body 2 has a discharge port 2*a* at the lower left end portion in the drawing thereof, to which an elastic film 6 having an H-shaped slit is adhered. An operating member 7 projects partly from the upper surface in the drawing of the container body 2.

Figure 2:
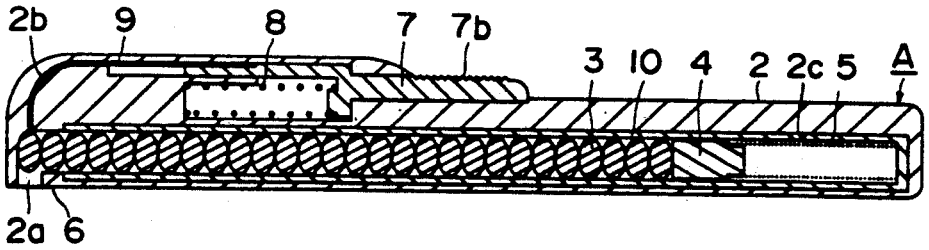
FIG. 2 is a sectional view taken along the line 2—2 in FIG. 1.
Figure 5:
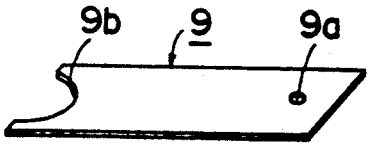
FIG. 5 is a perspective view of a pressing member of the embodiment of FIG. 1.

As shown in FIG. 2, the operating member 7 is urged to the right in the drawing by a resilient member 8, such as a coiled spring. When the operating member 7 is pressed against the resilient force of the resilient member 8, it is moved slidingly to the left in the drawing. The operating member 7 has a pressing member 9 extending from an end of the operating member 7. The pressing member 9 consists of a deformable part, for example, a metal plate spring or a thin plate of a synthetic resin, and is inserted into an arcuate slit 2*b* in the container body 2 shown in FIG. 3 so that the pressing member 9 can be moved slidingly within the slit 2*b*. As shown in FIGS. 4 and 5, the operating member 7 has a projection 7*a* and an undulated operating portion 7*b*, and the pressing member 9 has a hole 9*a* and a pressing end 9*b* which contacts and presses the granular bodies 3. The pressing member 9 is combined with the operating member 7 by fitting the projection 7*a* in the hole 9*a*. When a force is applied by a finger tip to the operating portion 7*b* of the operating member 7, the pressing member 9 is also moved with the operating member 7.

Since the deformable pressing member 9 is restricted by, and moved in, the arcuate slit 2b in the container body 2, the pressing end 9b is moved down in the drawing. The pressing end 9b of the pressing member 9 thus moved presses a granular body 3 to discharge the same from the discharge port 2a. A granular body 3 can thus be discharged sideways with respect to the longitudinal arrangement of the granular bodies 3 by applying a force to the same in the axial direction thereof, and this enables a compact structure for a portable granular body discharge container which can be conveniently carried. In the illustrated embodiment, the arcuate slit 2b in the container body 2 constitutes, and serves as, a direction converter for a pressing force. The elastic film 6 protects the granular bodies 3 from being soiled, and prevents a granular body 3 from being too forcibly and rapidly discharged. This elastic film 6 can also be formed so that it holds a granular body 3 resiliently at the time when the operating member 7 and pressing member 9 are moved to a maximal extent. If this operation is carried out repeatedly, the granular bodies 3 are discharged one by one according to the order of the longitudinal arrangement. During this time, the arrow (FIG. 1) on the granular body receiving member 4 reaches the position of an adjacent indication of a day of the week every time one granular body 3 is discharged. Thus, the granular body receiving member 4 constitutes an index for the indications 1b.

Figure 3:
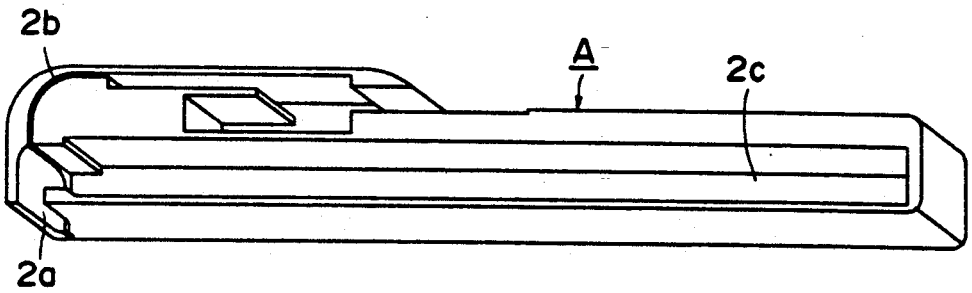
FIG. 3 is a perspective view of a body of the container in the embodiment of FIG. 1.
Figure 4:
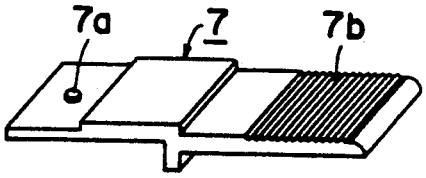
FIG. 4 is a perspective view of an operating member of the embodiment of FIG. 1.
Figure 6:
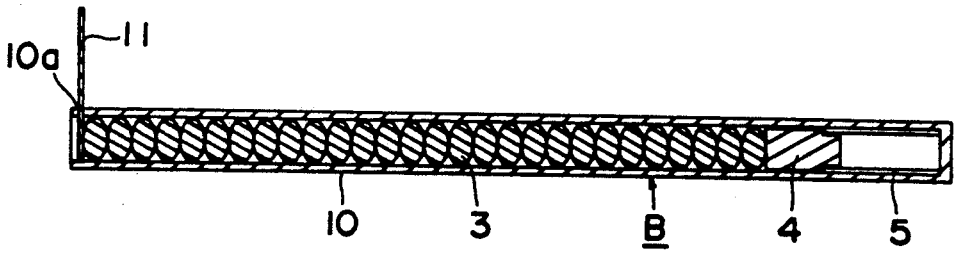
FIG. 6 is a sectional view of a granular body storage tube according to the present invention.

In the container body 2 shown in FIG. 3, reference numeral 2c represents a granular body storage portion. As shown in FIG. 2, the granular bodies 3, such as tablets, are not directly held in the granular body storage portion 2c. They are indirectly held in the storage portion 2c via a tubular member designated by reference numeral 10. The tubular member 10 consitutes a so-called refill which is used by replacing an old tubular member with a new one when the granular bodies 3 in the tubular member 10 are consumed, and it also constitutes a "storage tube body" of a granular body storage tube B, which is shown in FIG. 6.

Figure 7:
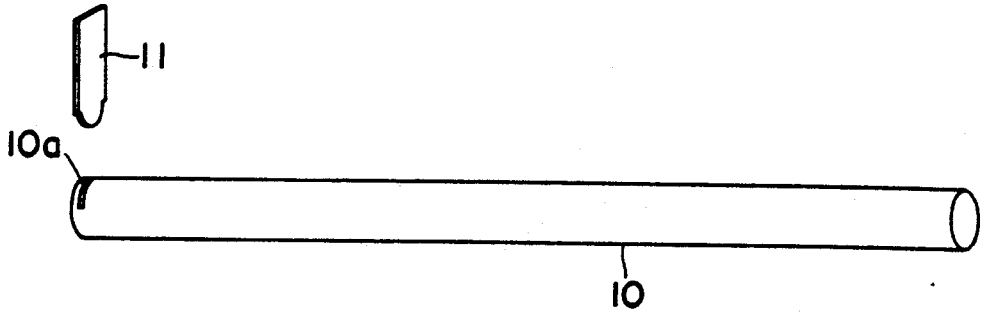
FIG. 7 is a perspective view of the granular body storage tube shown in FIG. 6 and a plug.

As shown in FIG. 7, the storage tube body 10 has a slot 10a at one end thereof, and a planar plug 11 is releasably inserted into the slot 10a. The plug 11 prevents the granular bodies 3 from jumping out of the storage tube body 10 due to the resilient force of a resilient member 5. The cover 1 of the container A (FIG. 1) is removed, and the granular body storage tube B (FIG. 6) is inserted into the storage portion 2c of the container body 2. The plug 11 is then removed, and the cover 1 is put over the container body 2. The granular body storage tube B can thus be used suitably as a refill for the granular body discharge container A, though it can, of course, be used by itself as a granular body holder. The granular body storage tube B can constitute at least a part of the granular body storage portion of the granular body discharge container A.

Other embodiments will now be described. The parts and elements which are basically identical with those in the embodiment decribed above will be designated by the same reference numerals.

Figure 8:
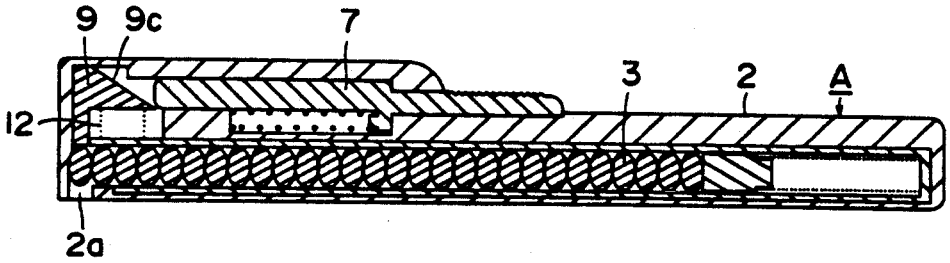
FIG. 8 is a sectional view of a discharge container according to another embodiment of the present invention.

In an embodiment shown in FIG. 8, an operating member 7 and a pressing member 9 are not combined unitarily. The pressing member 9 is spring-biased upwardly by a resilient member 12, and has a tapering wall 9c extending toward the operating member 7. When the operating member 7 is moved toward the pressing member 9, the pressing member 9 moves down toward a discharge port 2a against a spring force of a resilient member 12 due to the component of a contact force on the tapering wall 9c. Namely, in the embodiment of FIG. 8, the tapering wall 9c constitutes and serves as a direction converter for effectively pressing the pressing member 9.

Figure 9:
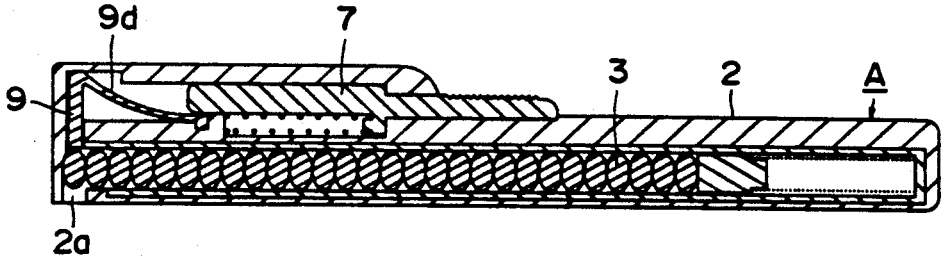
FIG. 9 is a sectional view a the discharge container according to still another embodiment of the present invention.

In an embodiment shown in FIG. 9, a pressing member 9 has an elastically deformable portion 9d having an extended end fixed to the container body 2. The basic functions of this embodiment are similar with those of the embodiment of FIG. 8.

Figure 10:
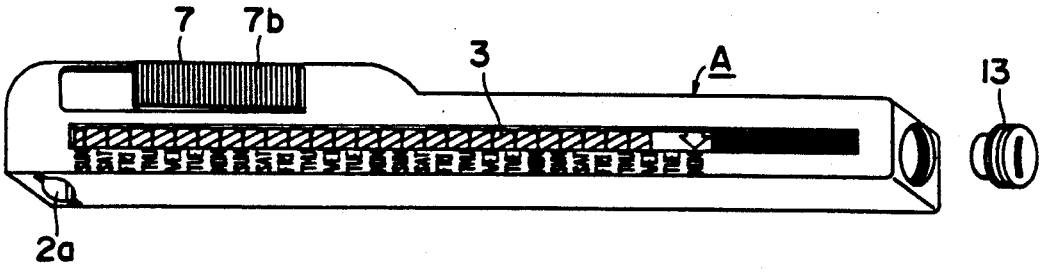
FIG. 10 is a perspective view of a discharge container according to another embodiment of the present invention.

In an embodiment shown in FIG. 10, a granular body discharge container A is not divided into a cover 1 and a container body 2, and it has a granular body inserting plug 13 at a bottom portion (right end in the drawing) thereof Although a previously-mentioned granular body storage tube B is not readily applicable, this embodiment is suitable and convenient for inserting granular bodies 3 into a storage portion 2c. In this embodiment, the surface of the operating portion 7b of the operating member, which projects from the container body 2, is formed differently from the corresponding surfaces of the above-described embodiments, and positioned beside the window on the same plane of the container. It is considered that the embodiment of FIG. 10 operated more easily by a right-handed person.

Figure 11:
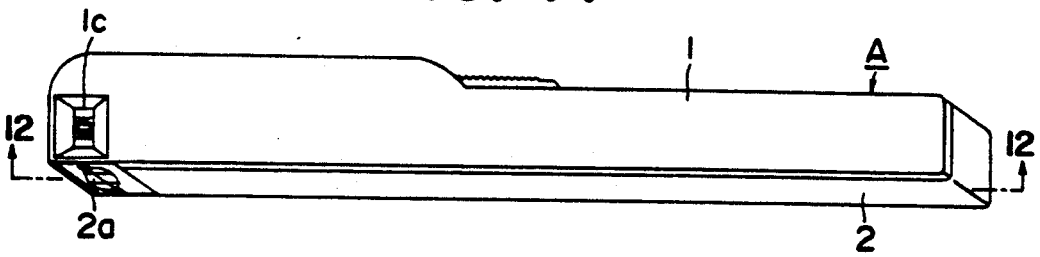
FIG. 11 is a perspective view of a discharge container according to a further embodiment of the present invention.
Figure 12:
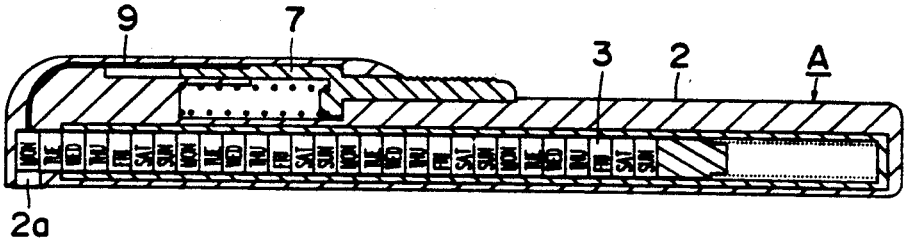
FIG. 12 is a sectional view taken along the line 12—12 in FIG. 11.

In an embodiment shown in FIGS. 11 and 12, a cover 1 for a granular body discharge container A has a small window 1c in the vicinity of a discharge port 2a, and the days of the week are not shown thereon. Instead, each of the granular bodies 3 held in the container has the indication of a day of the week thereon as shown in FIG. 12. In this case, the granular bodies can be distinguished from one another easily even if excessive granular bodies are discharged.

Figure 13:
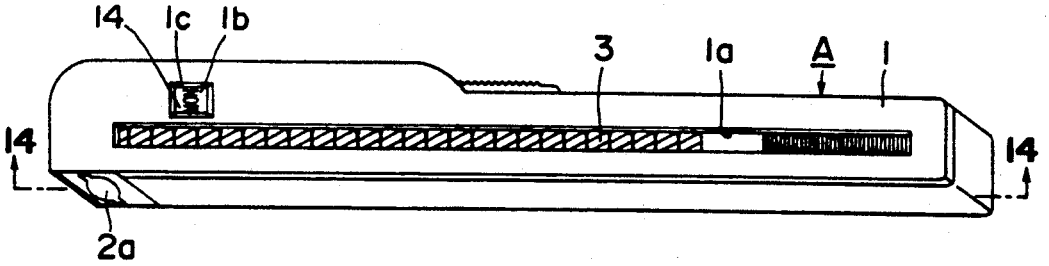
FIG. 13 is a perspective view of a discharge container according to a further embodiment of the present invention.
Figure 14:
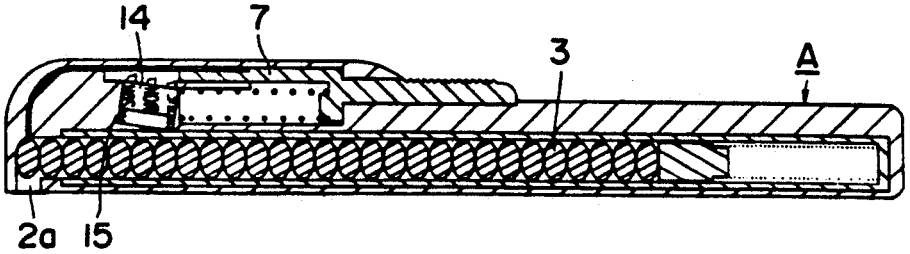
FIG. 14 is a sectional view taken along the line 14—14 in FIG. 13.
Figure 15:
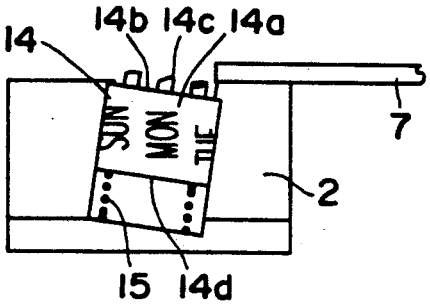
FIG. 15 is an enlarged view of a display of the days of the week in the embodiment of FIG. 13.
Figure 16:
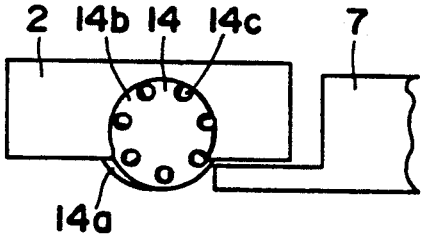
FIG. 16 is a top view of the display of FIG. 15.

In an embodiment shown in FIGS. 13 and 14, indications 1b are provided not along a window 1a in a cover 1 but inside a small window 1c. Namely, a rotary body 14 is provided on the inner side of the small window 1c so that the rotary body 14 can be seen therethrough. The rotary body 14, which is adapted to be turned in accordance with the pressing operation of the operating member 7 to display a day of the week, will be described with reference to FIGS. 15–22.

The rotary body 14 is formed generally in the shape of a cylinder, and has names of days of the week, such as Monday, Tuesday, Wednesday, etc. on a on its circumferential wall 14a, and seven locking projections 14c on its side wall 14b (which will hereinafter be referred to as "locking wall"). The container body 2 houses the rotary body 14 so that the rotary body 14 can be turned on its axis and slidably move in the axial direction of the rotary body 14. However, sliding movement of the rotary body 14 is restricted by a resilient member 15, which biases the locking wall 14b, and by an opposite wall 14d of the rotary body 14. The rotary body 14 is therefore slidingly moved in the axial direction when an external force in the axial direction, which is larger than the resilient force of the resilient member 15, is applied thereto. This external force is applied to the rotary body 14 by the operating member 7. The sliding movement direction of the operating member 7 and the rotational direction of the rotary body 14 are neither parallel nor perpendicular to each other, but are diagonal with respect to each other. The operating member 7 presses the rotary body 14, with the former contacting the projections 14c or the locking wall. Referring to FIG. 14, the operating member 7 consists of two parts, but it can be formed integrally or in combination out of suitable materials in suitable shapes It may, of course, consist of one part.

Figure 17:
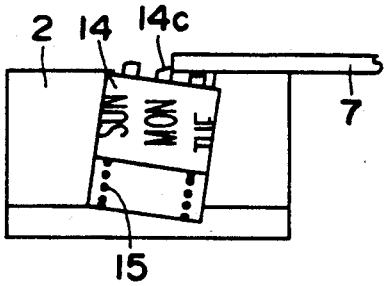
FIG. 17 is an enlarged view illustrating a starting stage of the pressing of an operating member shown in FIG. 15.
Figure 18:
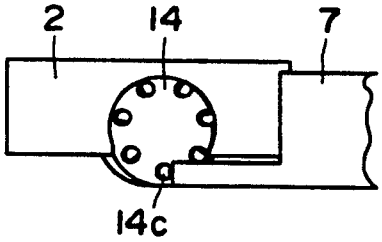
FIG. 18 is a top view of the display shown in FIG. 17.
Figure 19:
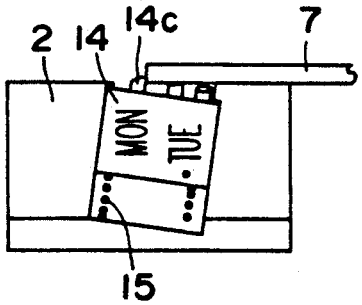
FIG. 19 is an enlarged view illustrating an intermediate stage of the pressing of the operating member shown in FIG. 15.
Figure 20:
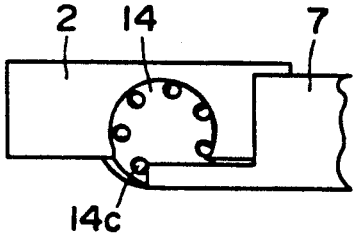
FIG. 20 is a top view of the display shown in FIG. 19.
Figure 21:
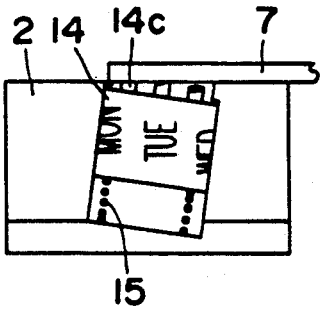
FIG. 21 is an enlarged view illustrating a final stage of the pressing of the operating member shown in FIG. 15.
Figure 22:
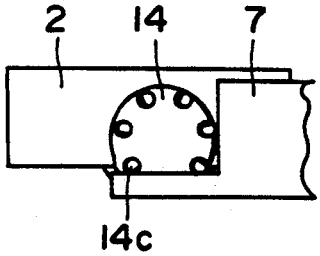
FIG. 22 is a top view of the display shown in FIG. 21.

When the operating member 7 advances, it contacts one of the projections 14c at a predetermined position as shown in FIGS. 17 and 18. Consequently, the rotary body 14 is rotated. When the operating member 7 is further moved forwardly, an adjacent projection 14c comes beneath the lower surface of the operating member 7 (FIGS. 19 and 20). If a desired angle of rotation of the rotary body 14 has been attained in the condition shown in FIGS. 19 and 20, the forward movement of the operating member 7 may be stopped in this stage of the movement thereof, In this embodiment, a unit angle of rotation, or the pitch, of the rotary body 14 is determined to a level corresponding to a distance of movement of a projection 14c berween a position in which the projection 14c contacts the operating member 7 and a position in which the projection 14c fully escapes therefrom (FIGS. 21 and 22, so that the amount of forward movement of the operating member 7 may not be limited during operation. The operating member 7 is moved back, and then forward again. Repeating these operations enables the rotary body 14 to be rotated gradually by a predetermined angle (i.e., a pitch) at a time. Accordingly, when the operating member 7 is moved forward to cause the pressing member 9 to move forward while deforming the same, a granular body 3 is discharged, and this operation changes the indication of the name of a day of the week. The rotary body 14 may have recesses instead of the projections 14c, as long as they serve as locking members. Instead, a recess can be suitably formed in the lower surface of the operating member 7 so that the operating member 7 contacts a projection 14c only when the operating member 7 is moved back to enable the rotary body 14 to be slidingly moved (not shown).

Figure 23:
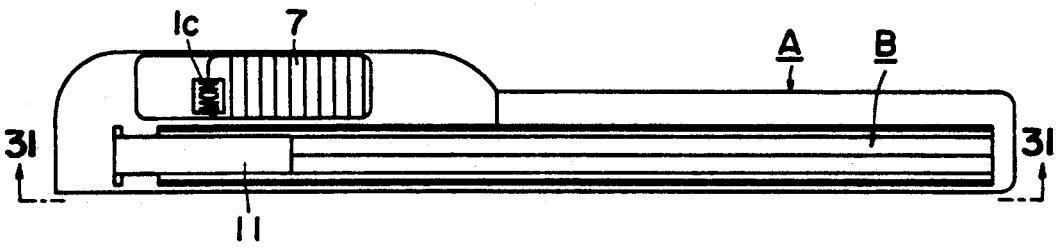
FIG. 23 is a side elevation of a granular body discharge container according to a further embodiment of the present invention.

In an embodiment shown in FIG. 23, a small window 1c is disposed at the portion a which indications of the names of days of the week are intermittently exposed by the sliding motion of the operating member 7 and, in addition, a granular body storage tube B is installed in such a different manner as is described below.

Figure 24:
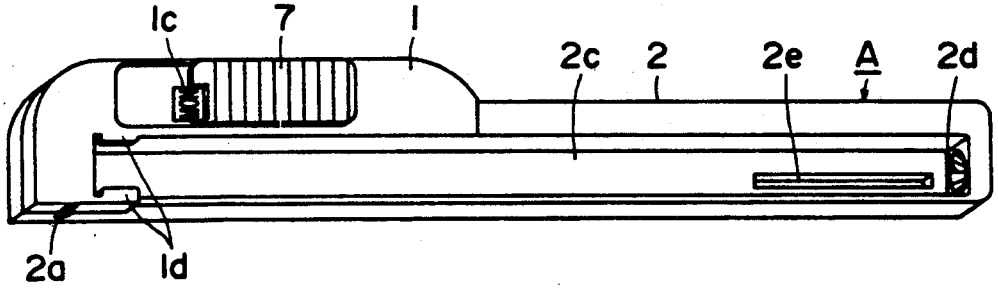
FIG. 24 is a perspective view of the discharge container of FIG. 23.
Figure 25:
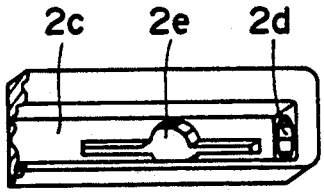
FIG. 25 is a perspective view of a principal portion of the discharge container of FIG. 23, showing another example of the shape of a rear hole therein.
Figure 26:
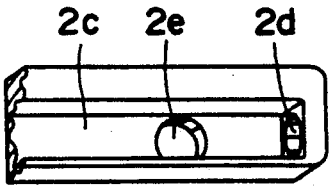
FIG. 26 is a perspective view of a principal portion of the discharge container of FIG. 23, showing still another example of the shape of the rear hole.

As shown in FIG. 24, the granular body storage portion 2c, in which a granular body storage tube B is set, of a discharge container A, is formed as a recessed portion which is opened at its side wall along substantially the full length of the rod-shaped discharge container. The storage portion 2c has a conical recess or a through hole 2d in the bottom wall (at the right end in the drawing), and a rear window 2e in The vicinity of this recess 2d. The cover 1 extends only over the vicinity of this recess 2d. The cover 1 extends only over the portion of a discharge container body which is in the vicinity of an operating member 7, and has a narrow portion (extending in a confronting relation and vertically in the drawing) over a head at one end of the granular body storage portion 2c. The narrow portion comprises holding portions 1d for a granular body storage tube B. The rear window 2e constitutes an insert recess for a coin, and is formed so as to enable removal of the storage tube B easily. This recess may also be formed in the shape of a circle, or a circle with wings, as shown in FIGS. 25 and 26, in such a manner that the tip portion of a writing instrument can be inserted therein.

Figure 27:
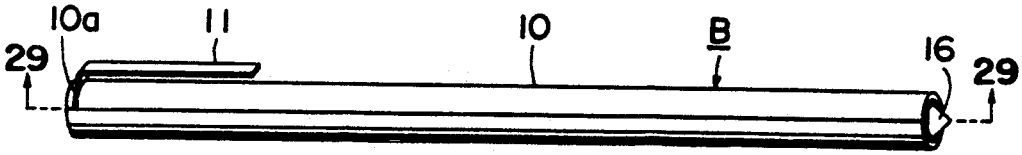
FIG. 27 is a perspective view of a granular body storage tube shown in FIG. 23.
Figure 28:
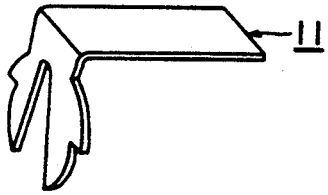
FIG. 28 is an enlarged perspective view of a plug shown in FIG. 27.
Figure 29:
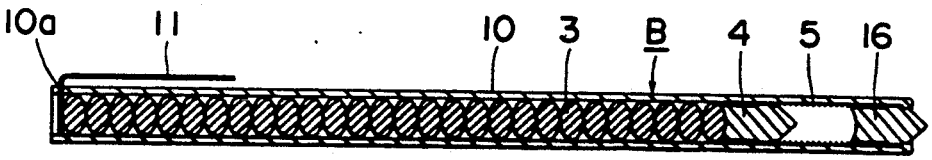
FIG. 29 is a cross-sectional view of the granular body storage tube of FIG. 27, taken along line 29—29 thereof.

The granular body storage tube B shown in FIG. 27 is set in the granular body discharge container A. As shown in FIG. 28, the shape of the plug 11 is also changed so that the plug 11 can provide a resilient deformation effect for the purpose of setting the plug 11 in the storage tube body 10 easily and reliably. In the embodiment of FIG. 27, there is provided a spring receiving member 16 projecting from a bottom portion (at the right end in the drawing) of the storage tube body as shown in FIG. 29. This spring receiving member 16 is engaged with the inner surface of the storage tube body 10 to prevent the same from flying out therefrom. The spring receiving member 16 shown in the drawing is formed to the same shape as a granular body receiving member 4 so as to employ common parts.

Figure 30:
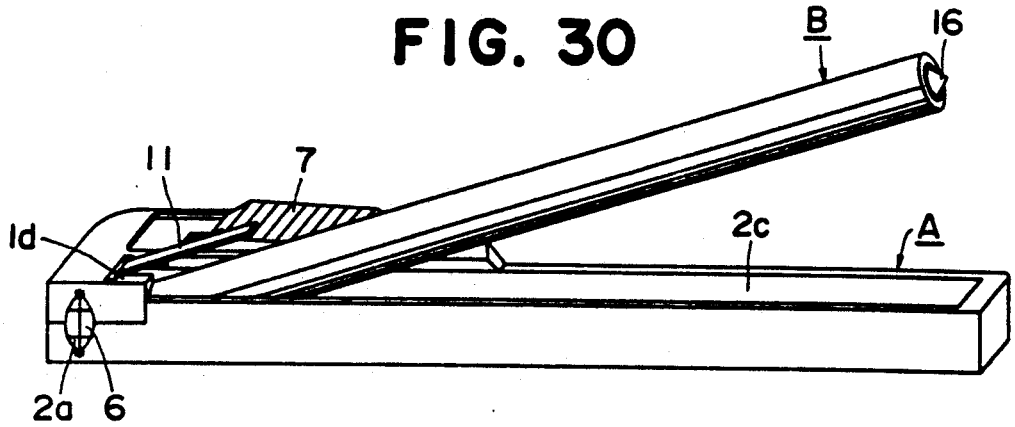
FIG. 30 is a perspective view illustrating the setting process of a granular body storage tube in a granular body discharge container.

The granular body storage tube B is set in the granular body discharge container A as shown in FIG. 30. Namely, the head portion of the granular body storage tube B is first inserted so that the plug 11 is positioned at the holding portions 1d, and the floating bottom portion is then pressed down. Consequently, the tapered rear portion, of the spring receiving member 16 which projects from the bottom portion of the storage tube body 10 of the granular body storage tube B, contacts the inner surface of a side wall of the granular body storage portion 2c, and the spring receiving member 16 moves resiliently and fits with a "click" fits in the granular body discharge container A. The discharge container A, with the granular bodies held therein in an unused state in the condition shown in FIG. 23, can be carried by a transportation means or by a user. With the granular body storage tube B holding granular bodies therein and set in the discharge container A as shown in FIG. 23 the granular bodies may be used freely by drawing, lifting and removing the plug 11. The plug 11 may be formed so as to be protected from the above by the holding portion 1d. For example, the width of the plug 11 is set slightly larger than the distance between the holding portions 1d so that the plug 11 can be removed by drawing and raising the same from the inner side of the holding portions 1d by utilizing the resiliency of the plug 11.

Figure 31:
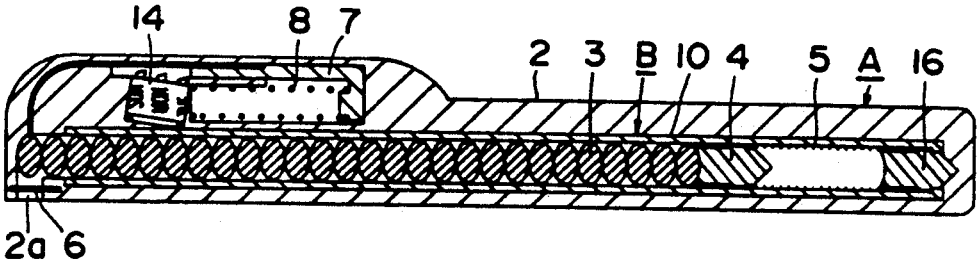
FIG. 31 is a sectional view taken along the line 31—31 in FIG. 23.
Figure 32:
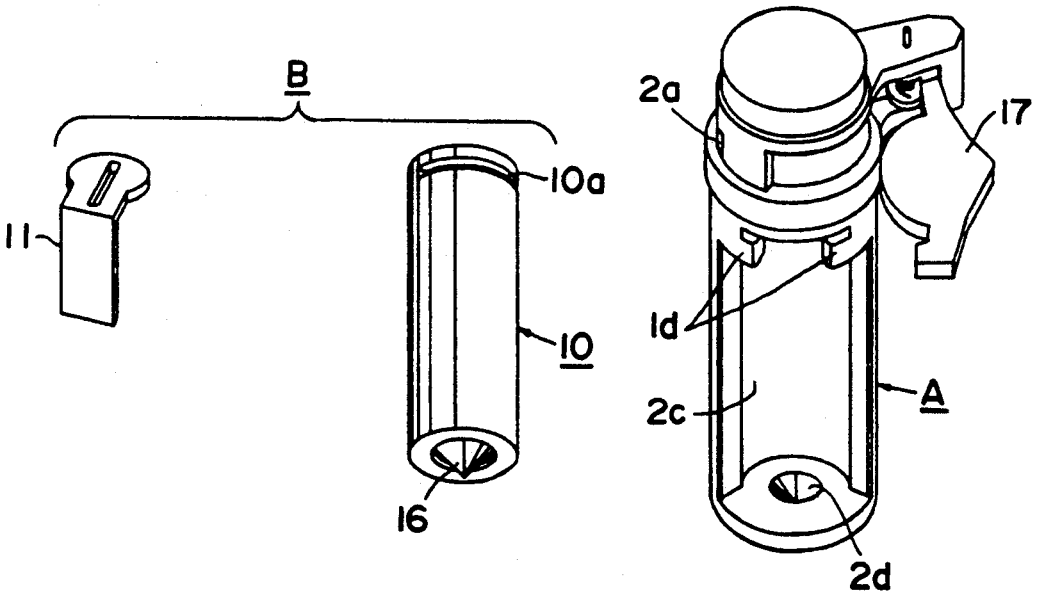
FIG. 32 is an exploded perspective view of a storage tube and a granular body discharge container according to a further embodiment of the present invention.

If the discharge container A is formed so that the storage tube B can be set in and removed from the storage portion 2c via the opened side wall thereof and fixed therein by the locking means at the bottom section thereof as in this embodiment, the storage tube B can be set easily and reliably. Since the storage tube B serves as a fixed portion of the discharge container A, by utilizing the resilient force of the resilient member 5 biasing the granular bodies 3, it constitutes a simple and convenient structure for the discharge container A. FIG. 31 shows the inner structure of the granular body discharge container Such a storage tube B can also be used in container. A shown in FIG. 32. In the discharge container A shown in FIG. 32, a pressing member 17 having a rotary shaft is resiliently mounted, and it is adapted to discharge the granular bodies by pulling (as shown in the drawing) the pressing member 17 against the resilient force thereof and releasing it.

Figure 33:
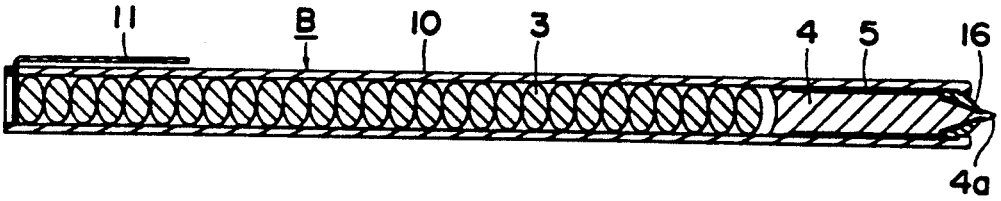
FIG. 33 is a sectional view showing a further embodiment of a granular storage tube.
Figure 34:
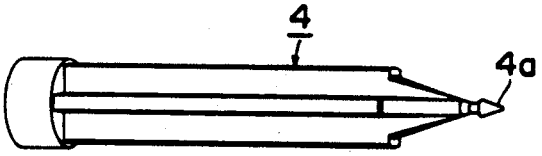
FIG. 34 is a perspective view of a granular body receiving member shown in FIG. 33.
Figure 35:
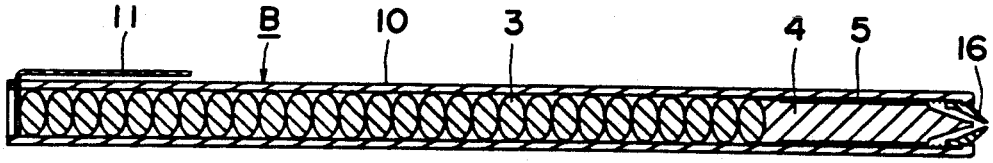
FIG. 35 is a sectional view of the granular body receiving member shown in FIG. 33 from which a resilient member receiving member is separated.
Figure 36:
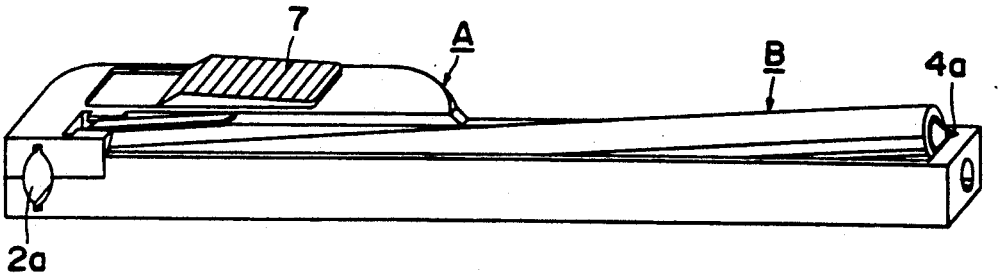
FIG. 36 is a perspective view of a discharge container showing the setting of a granular body storage tube as an example of separating a granular body receiving member and a resilient member receiving member from each other.

In a storage tube B of another embodiment shown in FIG. 33, a granular body receiving member 4 and a spring receiving member 16 are unitarily formed. Namely, as shown in FIG. 34, the granular body receiving member 4 has an arrowhead-shaped rear portion 4a which is inserted into and engaged with a hole in the spring receiving member 16. The resilient member 5 is combined with the members 4 and 16, with the resilient member 5 kept compressed. In order to use this granular storage tube B, the arrowhead-shaped rear portion 4a is cut off or removed by bending, as shown in FIG. 35, to obtain the effect of the resilient force of the resilient member 5. FIG. 36 shows an example of removing the arrowhead rear portion 4*a* by bending in which an operation for setting the storage tube B in the discharge container A constitutes such a method of removing the arrowhead rear portion.

Figure 37:
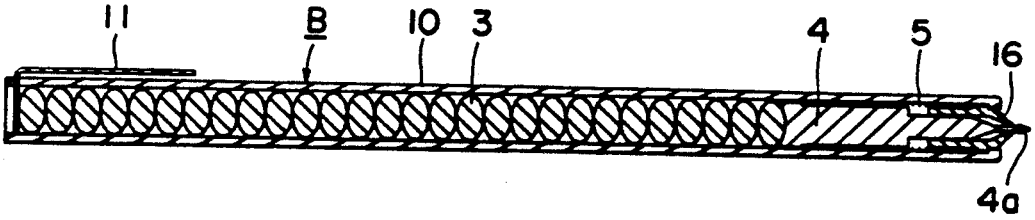
FIG. 37 is a sectional view of a granular body storage tube according to another embodiment.

A granular storage tube B shown in FIG. 37 is very similar to that shown in FIG. 33 except that the arrowhead-shaped rear portion 4*a* of the granular body receiving member 4 in the embodiment of FIG. 37 is not engaged with the spring receiving member 16. The resilient member 5 in this embodiment is slightly compressed so that the granular body receiving member 4 contacts the rearmost granular body 3.

Figure 38:
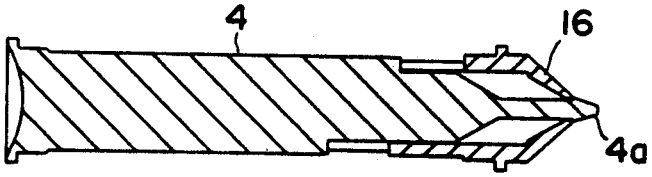
FIG. 38 is an enlarged view of a granular body receiving member and a resilient member receiving member shown in FIG. 37.
Figure 39:
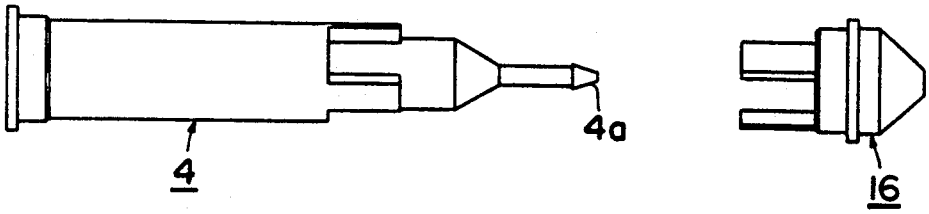
FIG. 39 is an exploded view in side elevation of the granular body receiving member and the resilient member receiving member shown in FIG. 38.

If the granular body receiving member 4 and the spring (resilient member) receiving member 16 are formed together as in these embodiments, it is not necessary for the resilient member 5 to be so greatly compressed when the granular bodies 3 are inserted into the storage tube B, and so the granular bodies 3 can be inserted thereinto easily. As may be understood from these embodiments, in which the unitary structure of the members has been stated, the granular body receiving member 4 and the spring (resilient member) receiving member 16 can be regarded as parts of the resilient member. If the granular body receiving member 4 and the spring receiving member 16 are formed to the shapes shown in FIG. 39, in such a manner that they are combined as shown in FIG. 38, a linearly compressed state of the resilient member 5 can be maintained stable if the resilient member 5 consists of a general coiled spring.

Figure 40:
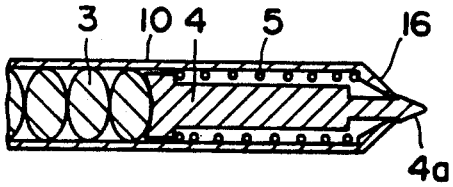
FIG. 40 is a sectional view of a principal portion of a granular body storage tube according to a further embodiment of the invention.

In an embodiment shown in FIG. 40, a storage tube body 10 consists of the same spring receiving member 16 as shown in FIGS. 33 and 37. If this embodiment is used in, for example, the granular body discharge container A shown in FIG. 24, the following effect is obtained. When the plug 11 is removed after the storage tube B has been set in the discharge container A, the storage tube body 10 is urged toward the recess 2*d* in the bottom wall of a granular body storage portion 2*c* and fixed therein by a reaction of the forward urging force of the resilient member 5 toward the granular bodies 3. This embodiment can reduce the number of parts.

Figure 41:
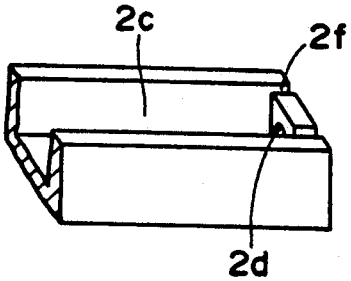
FIG. 41 is a perspective view of a principal portion of a granular body discharge container according to a further embodiment of the invention.

In an embodiment shown in FIG. 41, cuts 2*f* are provided in the bottom wall of the granular body storage portion 2*c* of the discharge container A so as to provide the discharge container A with a resilient force for setting a storage tube B therein. In the above-described embodiement in which the resilient force for setting the storage tube B in the discharge container A is given to the storage tube B by utilizing the resilient force of the resilient member 5, the resilient force of the resilient member 5 decreases gradually as the granular bodies 3 are consumed. Accordingly, the storage tube B can be set in the discharge container A reliably with a large resilient force, and removed therefrom with a small force. This embodiment is directed to a granular body discharge container if it is desired that a storage tube B be set therein with a predetermined level of resilient force, irrespective of the quantity of the granular bodies 3.

Figure 42:
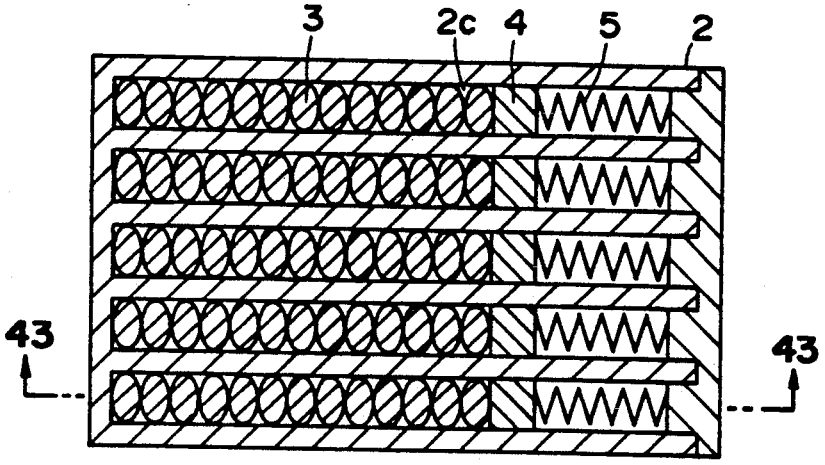
FIG. 42 is a sectional view of a granular body discharge container according to a further embodiment of the present invention.
Figure 43:
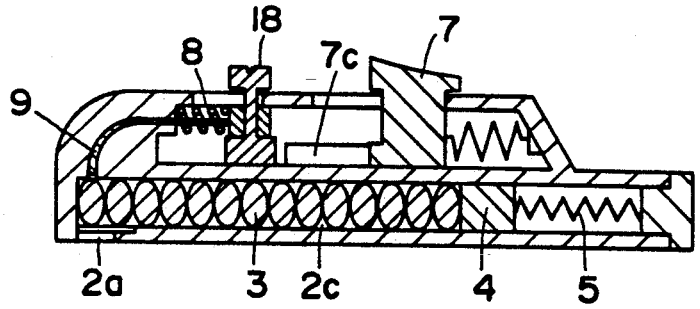
FIG. 43 is a longitudinal section taken along the line 43—43 in FIG. 42.
Figure 44:
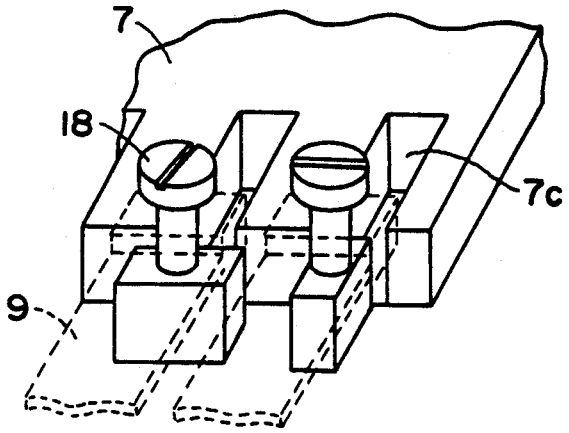
FIG. 44 is a perspective view of a principal portion of the discharge container in the embodiment of FIG. 43, showing the relation between an operating member and a rotary knob.

In an embodiment shown in FIGS. 42–44, a plurality of granular body storage portions 2*c* arranged in parallel with one another are provided. This embodiment is adapted to make it possible to suitably set the number of granular bodies to be discharged at a time, though a plurality of granular bodies 3 can be discharged at a time even in the above-described embodiments by varying the size of the discharge port 2*a* and the shape of the pressing end 9*b* of the pressing member 9. In the embodiment of FIGS. 42–44, a rotary knob 18 combined unitarily with a pressing member 9 is provided between an operating member 7 and the pressing member 9 so as to carry out the following operations. When the rotary knob 18 is turned so as to change the direction thereof, it fits freely in a recess 7*c* provided in the operating member 7 so that the pressing member 9 is not moved even if the pressing member 7 is pressed, or it faces in the direction in which it does not fit in the recess 7*c* so that the pressing member 9 is moved if the operating member 7 is pressed, these two operations being carried out selectively. A combination of predetermined quantities of a plurality of kinds of medicines, such as vitamin tablets, can be used repeatedly in this embodiment by simple operations. In this embodiment, granular bodies 3 are inserted directly in the discharge container A, but they can, of course, be held in the discharge container A by using the above-described granular body storage tubes B.

The present invention has been described with reference to some preferred embodiments thereof, and can also be modified in various other ways without departing from the spirit thereof. For example, the granular body may be formed to suitable other shapes, such as a disc type shape and a cross-sectionally polygonal shape other than the illustrated flattened spherical shape, and the granular bodies having such shapes may be arranged in a line. The granular bodies may be arranged not only in a simple straight line but also, for example, zigzag or in a staggered manner. The granular body storage tube may be formed to a suitable shape, i.e., to a cylindrical shape and a cross-sectionally polygonal shape. The discharge container may also be formed to a suitable shape, and the shape can be determined relatively to a structure to be added thereto as in, for example, the case where a clip is attached to the discharge container so that the discharge container can be conveniently carried in a pocket. The direction in which the granular bodies are pressed, and that of the axis of an opening from which the granular bodies are discharged, may not agree with each other. For example, the discharge port can extend in the shape of the letter "L", with one end opened. Embodiments having indications of days of the week are shown, and dates and numbers may also be displayed suitably in accordance with the use of the granular bodies The illustrated granular body storage tube B is formed so that, when the plug 11 is removed after the storage tube B has been inserted in the container body 10, a granular body 3 projects slightly from the open end of the storage tube body 10. The through hole 10*a* from which the plug 11 has been removed can be utilized as an outlet for the granular bodies in the granular body storage tube B. Although the operating member 7 in the embodiments is adapted to be moved by sliding the operating portion 7*b* thereof, it may also be moved by knocking the same.

What is claimed is:

1. A discharge container, comprising:

a container body having a granular body storage portion arranged in a longitudinal direction of said container body, a discharge port in said container body at one end of said granular body storage portion and an operating unit for moving granular bodies from said granular body storage portion through said discharge port, said operating unit comprising an operation member mounted so as to be moveable in the longitudinal direction of said container body, a pushing portion for pushing the granular bodies from the sides thereof, and an engaging and converting member engaging said pushing portion with said operation member and converting the longitudinal movement of said operation member into lateral movement of said pushing portion, whereby granular bodies can be laterally discharged from said granular body storage portion in response to longitudinal movement of said operation member;

a storage tube for removable mounting in said granular body storage portion for holding a plurality of granular bodies in a line therein in said longitudinal direction of said container body, said storage tube having an open end, a removable stopper for blocking said open end and a resilient portion in the end opposite said open end for biasing granular bodies therein toward said open end, said resilient portion projecting out of said storage tube through said end opposite said open end for resiliently and releasably engaging said container body.

2. The discharge container of claim 1, wherein said storage tube has a through-hole in a side thereof adjacent to said open end, said removable stopper being removably disposed in said through-hole.

3. The discharge container of claim 1 wherein said resilient portion comprises:

a first member receiving a resilient member thereagainst; and a second member engaged by said resilient member for receiving and biasing the granular bodies;

wherein said first member has a projection projecting resiliently from said end opposite said open end of said storage tube for resiliently and releasably engaging said container body.

4. The discharge container of claim 3, wherein said first member has a hole extending therethrough and said second member has a tapered end projecting through said hole of said first member out of said storage tube, holding said first and said second members together before said storage tube is mounted in said granular body storage portion and compressing said resilient member therebetween, said tapered and being adapted to abut said container body and be disengaged from said first member when said storage tube is mounted in said granular body storage portion, allowing said resilient member to bias said second member against the granular bodies and toward said open end.

5. The discharge container of claim 1, wherein said resilient portion comprises a first member having an end projecting out of said storage tube for resiliently and releasably engaging said container body, a second member for engaging granular bodies in said storage tube and a spring therebetween biasing said first and second members in opposite directions.

6. The discharge container of claim 5, and further comprising means for immovably but releasably connecting said first and second members together with said spring therebetween.

7. The discharge container of claim 6, wherein said means comprises a through hole in said first member and a tapered end on said second member.

8. A discharge container, comprising:

a container body having a granular body storage portion arranged in a longitudinal direction of said container body, a discharge port in said container body at one end of said granular body storage portion and an operating unit for moving granular bodies from said granular body storage portion through said discharge port, said operating unit comprising an operation member mounted so as to be movable in the longitudinal direction of said container body, a pushing portion for pushing the granular bodies from the sides thereof, and an engaging and converting member engaging said pushing portion with said operation member and converting the longitudinal movement of said operation member into lateral movement of said pushing portion, whereby granular bodies can be laterally discharged from said granular body storage portion in response to longitudinal movement of said operation member;

wherein said container body has a window therein and a rotary member disposed in said container so as to be viewable through said window;

wherein said rotary member has display thereon for viewing through said window; and wherein said operation member has a part thereon engaging said rotary member upon movement of said operation member to rotate said rotary member and said display.

9. The discharge container of claim 8, wherein said rotary member is mounted at an angle relative to the longitudinal direction of movement of said operation member.

10. The discharge container of claim 9, wherein said rotary member is biased in a direction along its axis and toward said part of said operation member.

11. The discharge container of claim 10 wherein said rotary member has a plurality of projections thereon for engaging said part of said operation member.

12. The discharge container of claim 8, wherein said display comprises a plurality of different individual indicia corresponding to respective separate movements of said operation member in the longitudinal direction.

* * * * *